US011306514B2

(12) United States Patent
Lin

(10) Patent No.: US 11,306,514 B2
(45) Date of Patent: Apr. 19, 2022

(54) CONNECTION LOCK

(71) Applicant: LINTEX CO., LTD., Zhanghua County (TW)

(72) Inventor: Chia-Sheng Lin, Zhanghua County (TW)

(73) Assignee: LINTEX CO., LTD., Yuanlin Township (TW)

( * ) Notice: Subject to any disclaimer, the term of this patent is extended or adjusted under 35 U.S.C. 154(b) by 318 days.

(21) Appl. No.: 16/566,621

(22) Filed: Sep. 10, 2019

(65) Prior Publication Data

US 2021/0071446 A1 Mar. 11, 2021

(51) Int. Cl.
*E05B 73/00* (2006.01)

(52) U.S. Cl.
CPC ..... *E05B 73/0017* (2013.01); *E05B 73/0082* (2013.01)

(58) Field of Classification Search
CPC .. E05B 73/0017; E05B 73/0082; E05B 73/00; E05B 73/0005
USPC ..... 70/14, 18, 49, 57, 58
See application file for complete search history.

(56) References Cited

U.S. PATENT DOCUMENTS 6,058,744 A * 5/2000 Ling ..... E05B 37/025 70/28
6,619,081 B1 * 9/2003 Yu ..... E05B 73/0005 70/14
7,308,809 B2 * 12/2007 Lu ..... E05B 73/0082 70/14
10,233,676 B2 * 3/2019 Lin ..... E05B 73/0082
10,718,138 B2 * 7/2020 Wu ..... E05B 73/0082
2004/0168486 A1 * 9/2004 Ling ..... E05B 73/0082 70/58
2013/0340490 A1 * 12/2013 Wu ..... E05B 73/0082 70/58
2014/0026625 A1 * 1/2014 Wu ..... E05B 17/04 70/14
2014/0069153 A1 * 3/2014 Wu ..... E05B 73/0082 70/58
2014/0085788 A1 * 3/2014 Avganim ..... G06F 1/1656 361/679.01
2015/0059422 A1 * 3/2015 Kao ..... E05B 73/0082 70/58

* cited by examiner

*Primary Examiner* — Lloyd A Gall
(74) *Attorney, Agent, or Firm* — Muncy, Geissler, Olds & Lowe, PC

(57) ABSTRACT

A connection lock is provided. A driving assembly is disposed to a shell body, is movable to be in first or second positions and further has a restricting portion. A lock device is disposed to the shell body and includes a lock member which is movable relative to the shell body to be in unlocked or locked positions and has a tendency to move toward the locked position. An actuating member is slidably disposed in the shell body. A first elastic member is disposed in the shell body and abuts against one of the actuating member and the driving assembly to bias the driving assembly in a direction toward the first position. A engaging assembly is disposed in the shell body and is movable to be in released or engaged positions and is configured to be inserted into an anti-theft hole of an object.

14 Claims, 15 Drawing Sheets

CONNECTION LOCK

BACKGROUND OF THE INVENTION

Field of the Invention

The present invention relates to a connection lock.

Description of the Prior Art

In the modern society, the living quality is improving, and people lead a quick and busy life, so people have great demand for getting information instantly. Portable 3C products like laptops play an important role in everyday life and workplace, but this type of 3C products may be easily stolen because they are valuable, light and portable. To prevent a laptop from being stolen, an anti-theft chain for a laptop is provided, one of two ends thereof is for being locked with an anti-theft hole of the laptop, the anti-theft chain entangles on a desk leg to prevent detachment. When a user wants to unlock the anti-theft chain, s/he needs to use a key to plug into a lock so as to pull a locking member out from the anti-theft hole. This type of anti-theft chain for a laptop is disclosed in TWM390584. However, when the user wants to use the anti-theft chain for a laptop, s/he has to entangle the anti-theft chain on the desk leg, and the entangling process is complex. In addition, the size of the conventional anti-theft chain is larger because of the key hole thereof, so it is inconvenient to store or carry the anti-theft chain around.

The present invention has arisen to mitigate and/or obviate the afore-described disadvantages.

SUMMARY OF THE INVENTION

The major object of the present invention is to provide a connection lock, which can effectively prevent 3C products from being stolen, and the connection lock has a simple structure and is easy to operate.

To achieve the above and other objects, a connection lock is provided, including a shell body, a driving assembly, a lock device, an actuating member, a first elastic member and an engaging assembly. The driving assembly is disposed to the shell body and is movable to be in a first position or a second position, and the driving assembly further has a restricting portion. The lock device is disposed to the shell body, the lock device includes a lock member, the lock member is movable relative to the shell body to be in an unlocked position or a locked position, and the lock member has a tendency to move toward the locked position. The actuating member is slidably disposed in the shell body. The first elastic member is disposed in the shell body and abuts against one of the actuating member and the driving assembly to bias the driving assembly in a direction toward the first position. The engaging assembly is disposed in the shell body and is movable to be in a released position or an engaged position, and the engaging assembly is configured to be inserted into an anti-theft hole of an object. When the driving assembly is in the first position, the engaging assembly is in the released position and non-engageable against an edge of the anti-theft hole, the lock member is in the unlocked position and non-engageable against the restricting portion, and the driving assembly is freely movable toward the second position; when the driving assembly moves to the second position, the lock member moves to the locked position and is engaged with the restricting portion, the actuating member is driven by the driving assembly, the engaging assembly is actuated by the actuating member to move to the engaged position, and the engaging assembly is engaged with the edge of the anti-theft hole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
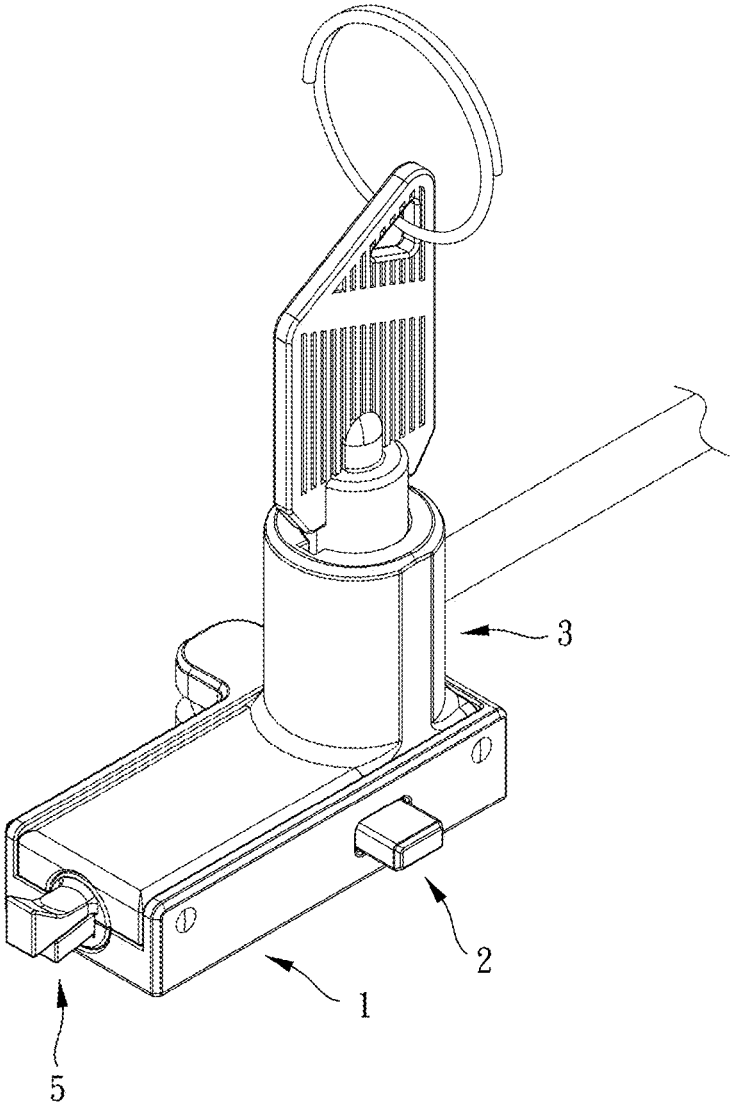
FIG. 1 is a stereogram of a first preferred embodiment of the present invention.
Figure 2:
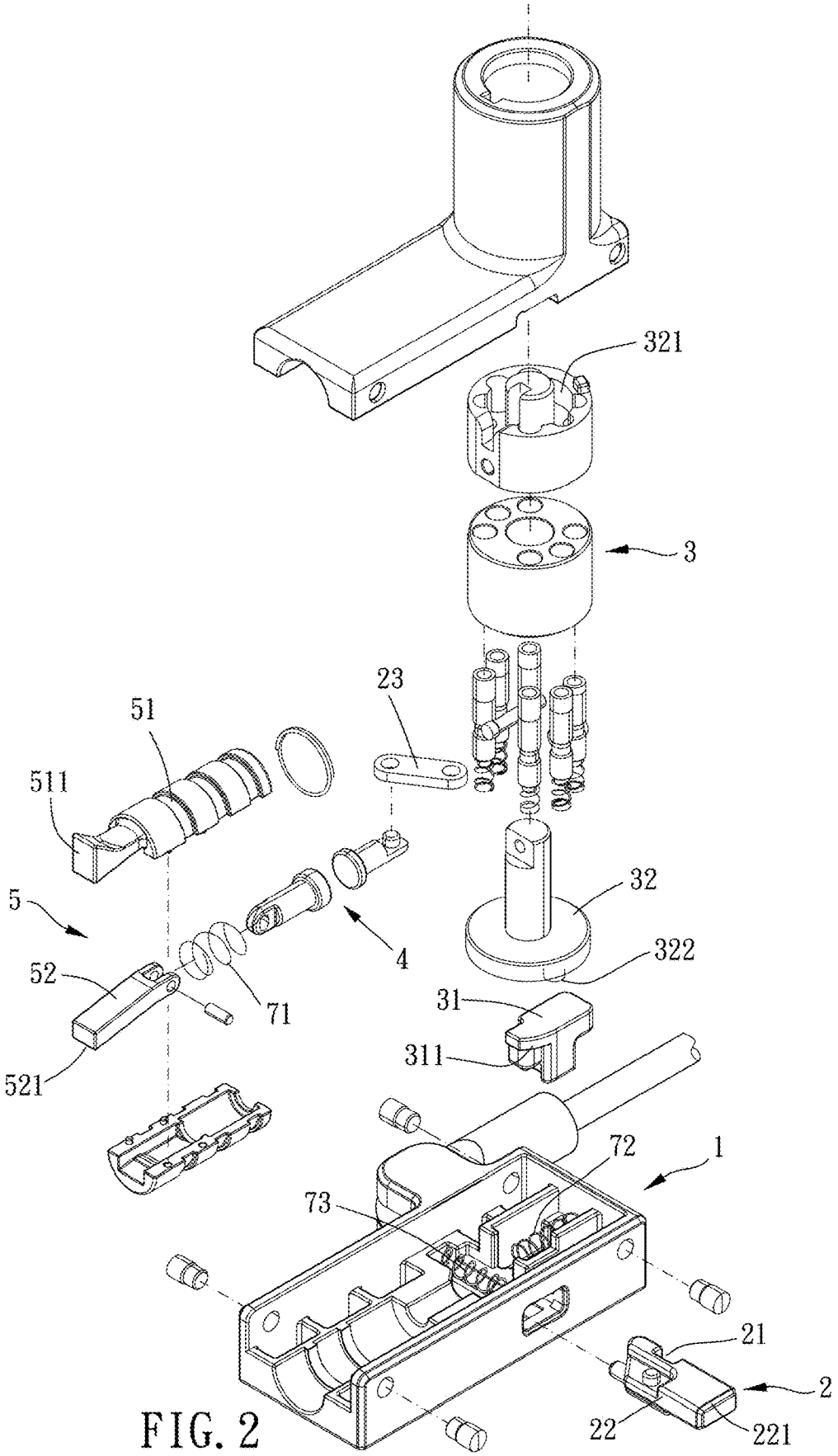
FIG. 2 is a breakdown view of the first preferred embodiment of the present invention.
Figure 3:
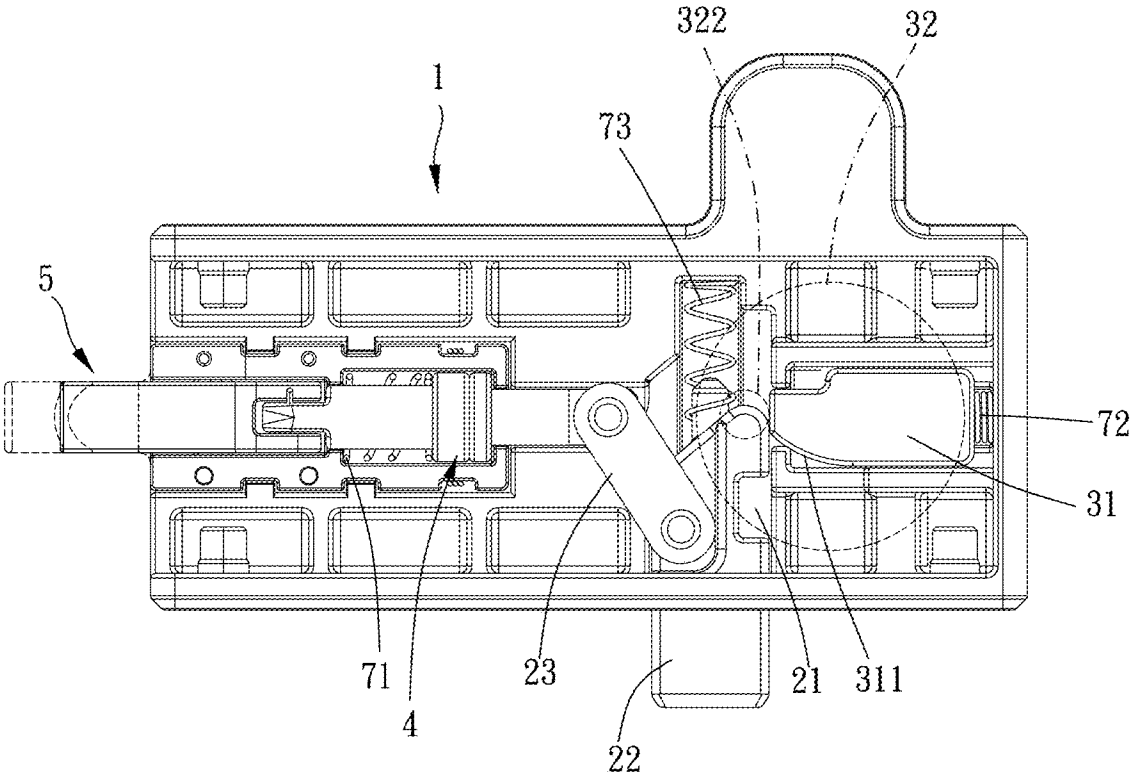
FIGS. 3 and 4 are top views of the first preferred embodiment of the present invention in operation.
Figure 5:
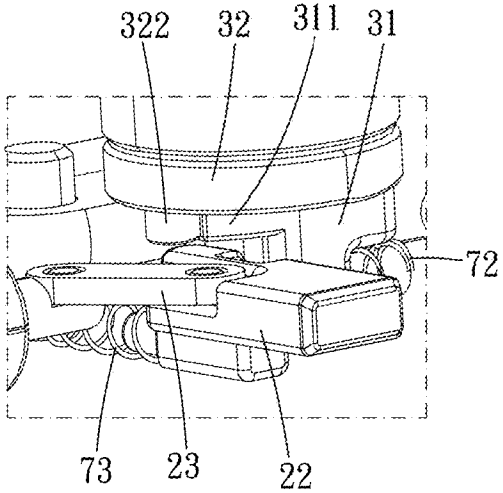
FIG. 5 is a partly view of the first preferred embodiment of the present invention.
Figure 4:
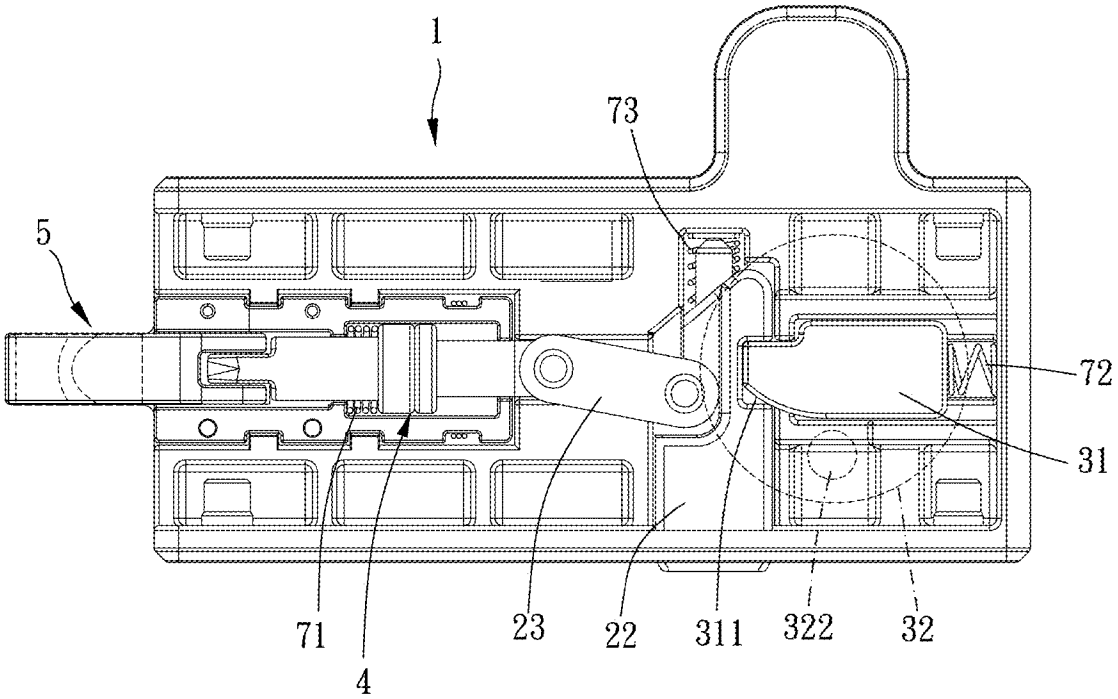
Figure 6:
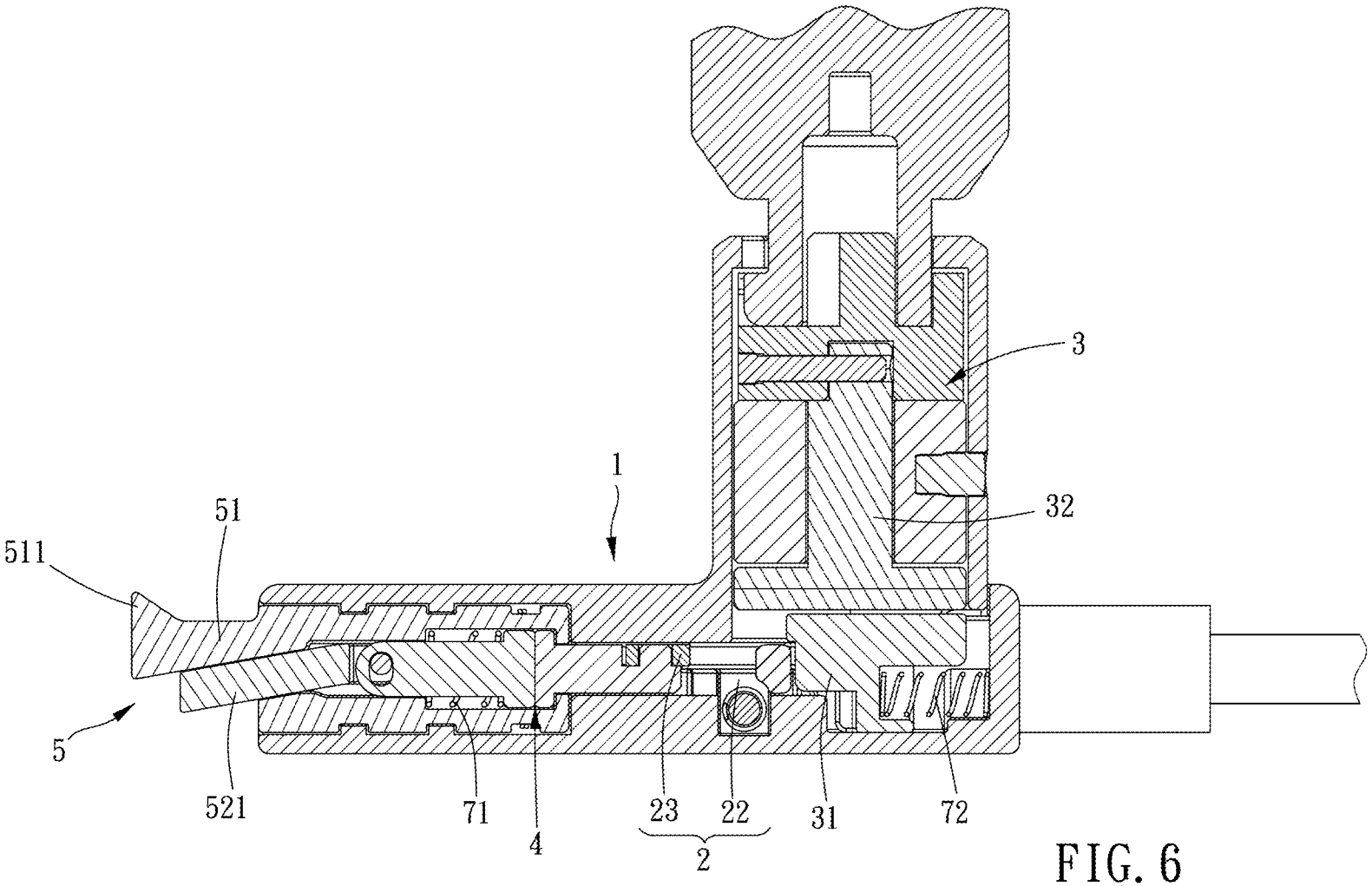
FIGS. 6 and 7 are cross-sectional side views of the first preferred embodiment of the present invention.
Figure 7:
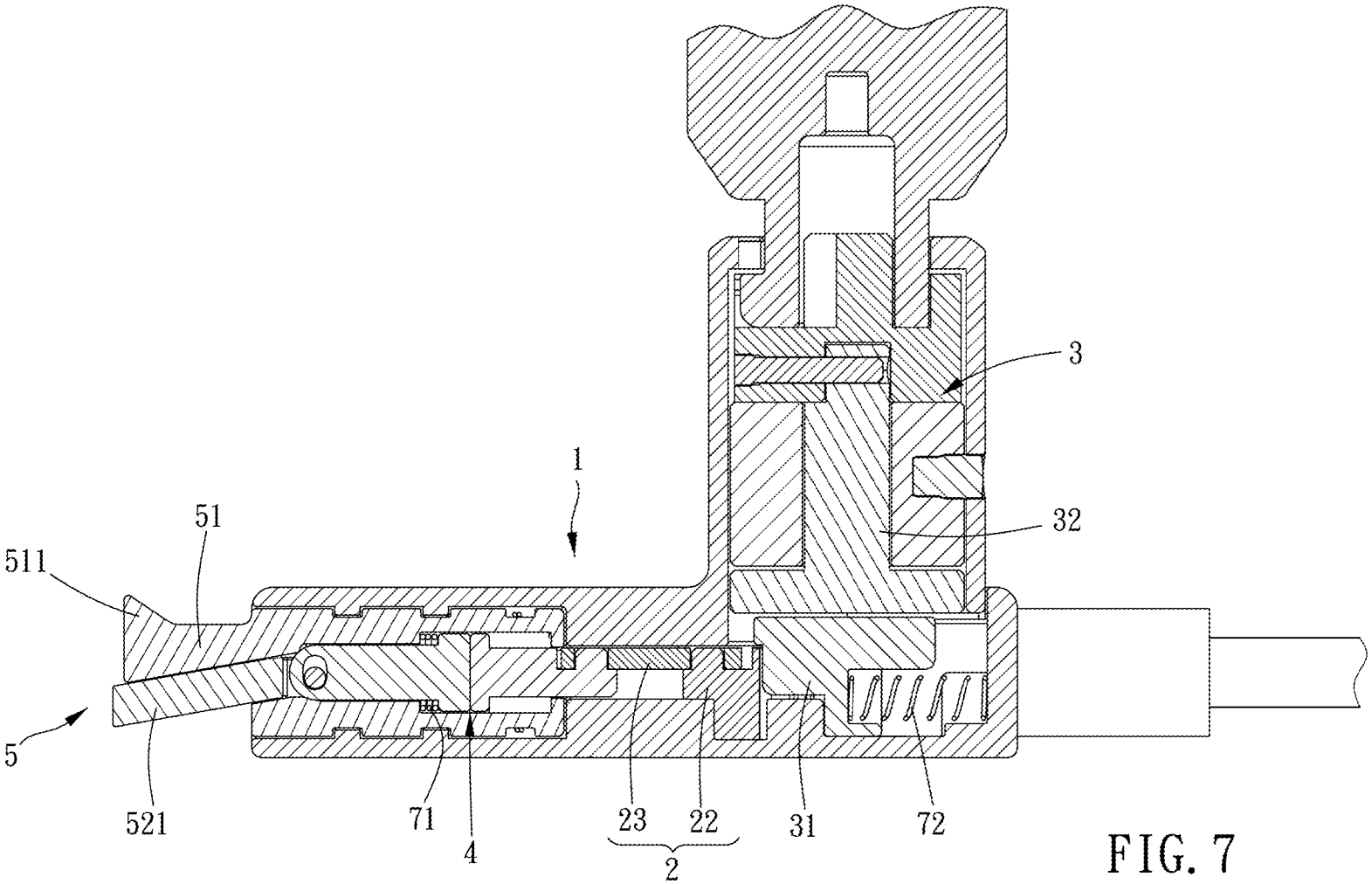

Please refer to FIGS. 1 to 7 for a first preferred embodiment of the present invention. A connection lock is provided, including a shell body 1, a driving assembly 2, a lock device 3, an actuating member 4, a first elastic member 71 and an engaging assembly 5.

The driving assembly 2 is disposed to the shell body 1 and is movable to be in a first position or a second position, and the driving assembly 2 further has a restricting portion 21.

The lock device 3 is disposed to the shell body 1, the lock device 3 includes a lock member 31, the lock member 31 is movable relative to the shell body 1 to be in an unlocked position or a locked position, and the lock member 31 has a tendency to move toward the locked position. In this embodiment, the restricting portion 21 is disposed in a recess of the driving assembly 2, and when the lock member 31 is in the locked position, the lock member 31 is inserted into and engaged with the recess. Preferably, the connection lock further includes a second elastic member 72, and the second elastic member 72 is arranged between the lock member 31 and the shell body 1 to bias the lock member 31 in a direction toward the locked position.

The actuating member 4 is slidably disposed in the shell body 1.

The first elastic member 71 is disposed in the shell body 1 and abuts against one of the actuating member 4 and the driving assembly 2 to normally actuate the driving assembly 2 to move toward the first position. In this embodiment, the first elastic member 71 is arranged between the shell body 1 and the actuating member 4, and the actuating member 4 has a tendency to move away from the engaging assembly 5 to actuate the driving assembly 2 to move toward the first position.

The engaging assembly 5 is disposed in the shell body 1 and is movable to be in a released position or an engaged position, and the engaging assembly 5 is configured to be inserted into an anti-theft hole of an object (for example, a laptop, a tablet or other 3C products).

When the driving assembly 2 is in the first position, the engaging assembly 5 is in the released position and non-engageable against an edge of the anti-theft hole, the engaging assembly 5 can be optionally disassembled from the anti-theft hole, the lock member 31 is in the unlocked position and non-engageable against the restricting portion 21, and the driving assembly 2 is freely movable toward the second position; when the driving assembly 2 is moved to the second position by a force, the lock member 31 moves to the locked position and is engaged with the restricting portion 21, the driving assembly 2 cannot move to the first position, the actuating member 4 is driven by the driving assembly 2 (in this embodiment, the actuating member 4 moves toward the engaging assembly 5), the engaging assembly 5 is driven by the actuating member 3 to move to the engaged position, the engaging assembly 5 is engaged with the edge of the anti-theft hole, and the engaging assembly 5 cannot be detached from the anti-theft hole so as to prevent the object from being stolen.

Specifically, the driving assembly 2 includes a control member 22 and a linkage 23, the control member 22 has a control end 221, the control end 221 is outside the shell body 1, the control end 221 is movably arranged on the shell body 1, and two ends of the linkage 23 are respectively pivoted to the actuating member 4 and the control member 22. In addition, the control member 22 is slidably arranged in the shell body 1, a sliding direction of the control member 22 is lateral to a sliding direction of the actuating member 4, and the control member 22 is slidable between the first position and the second position. Thereby, when the control member 22 slides to the second position, the linkage 23 actuates the actuating member 4 to make the actuating member 4 actuate the engaging assembly 5 to the engaged position.

The connection lock further includes a third elastic member 73, the third elastic member 73 is arranged between the shell body 1 and an end of the control member 22 remote from the control end 221 so that the control member 22 has a tendency to move toward the first position.

The lock device 3 has a rotating member 32, the rotating member 32 has a key hole 321, an end of the rotating member 32 remote from the key hole 321 has a protrusion 322, and when the rotating member 32 rotates, the protrusion 322 abuts against the lock member 31 to move to the unlocked position. When a user wants to disassemble the engaging assembly 5 from the anti-theft hole, s/he only needs to insert a key into the key hole 321 to rotate the rotating member 32, then the protrusion 322 can abut the lock member 31 to the unlocked position, the actuating member 4 is biased by the first elastic member 71 to move away from the engaging assembly 5, and the control member 22 is actuated by the third elastic member 73 to move toward the first position to reset.

The lock member 31 has an inclined plane 311, the inclined plane 311 tilts toward a moving direction of the lock device 31, and the protrusion 322 abuts against the inclined plane 311 so that the protrusion 322 can move the lock member 31 to the unlocked position.

The engaging assembly 5 includes a first engaging member 51 and a second engaging member 52 which are movable relative to each other, an end of the first engaging member 51 and an end of the second engaging member 52 remote from the actuating member 4 respectively have a first clip 511 and a second clip 521, when the engaging assembly 5 is in the engaged position, the first and the second clips 511, 521 move relative to each other to be engaged with the edge of the anti-theft hole; and when the engaging assembly 5 is in the released position, the first and the second clips 511, 521 move relative to each other to be non-engaged with the edge of the anti-theft hole. Specifically, in this embodiment, the first engaging member 51 is fixedly disposed to the shell body 1, the second engaging member 52 is slidably arranged in the shell body 1 and rotatably connected to the actuating member 4, when the actuating member 4 moves away from the driving assembly 2, the actuating member 4 actuates the second engaging member 52 to move toward an outside of the shell body 1 so that the first and second clips 511, 521 are aligned with each other, and the engaging assembly 5 is in the engaged position; when the actuating member 4 moves away from the engaging assembly 5, the actuating member 4 actuates the second engaging member 52 to move toward an inside of the shell body 1 so that the first and second clips 511, 521 are non-aligned with each other, and the engaging assembly 5 is in the released position.

Figure 8:
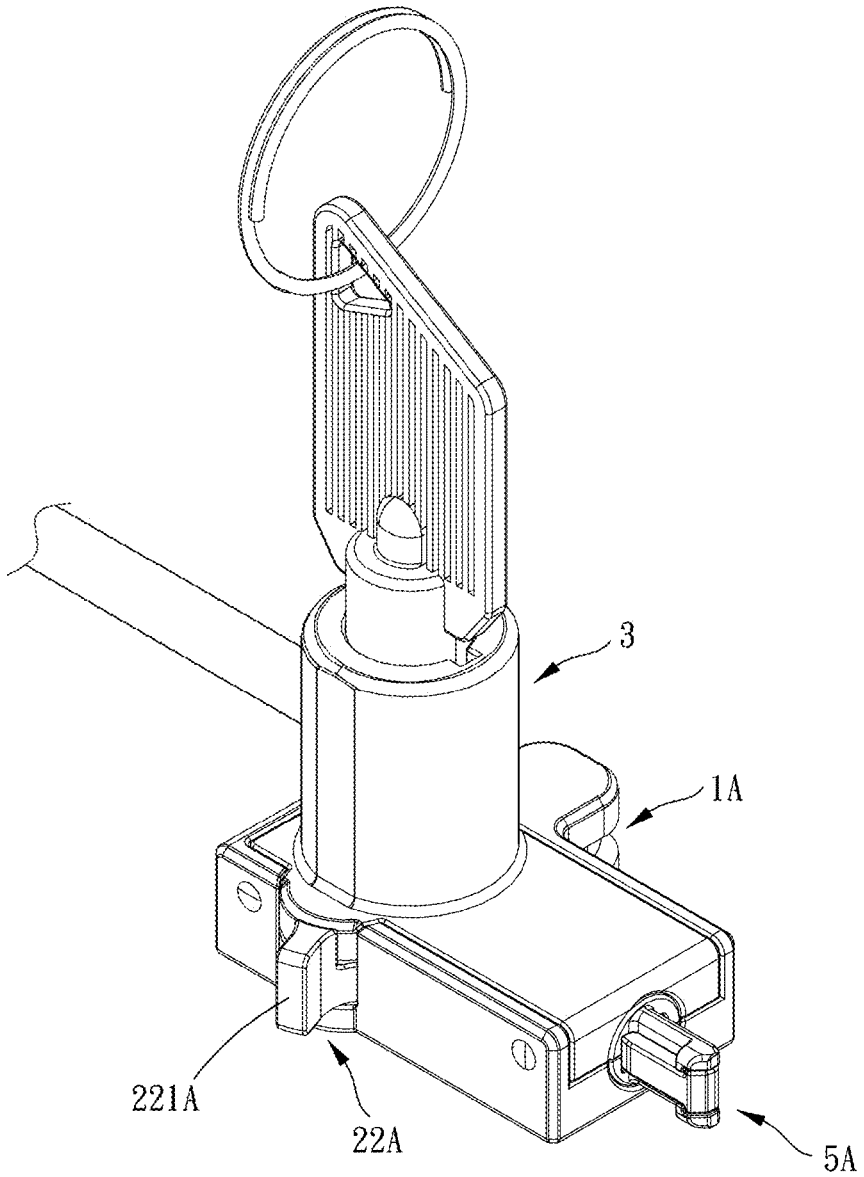
FIG. 8 is a stereogram of a second preferred embodiment of the present invention.
Figure 9:
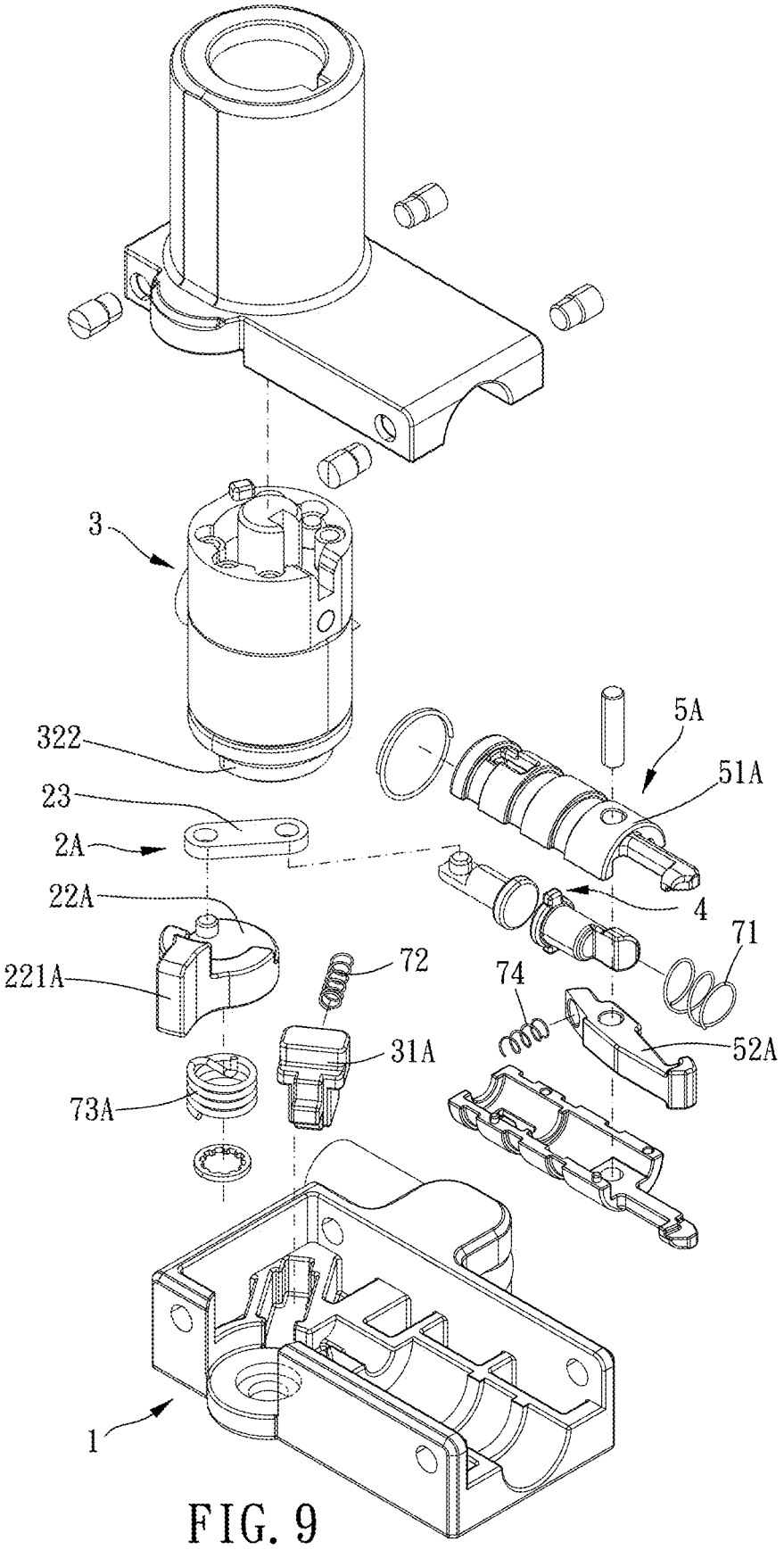
FIG. 9 is a breakdown view of the second preferred embodiment of the present invention.
Figure 10:
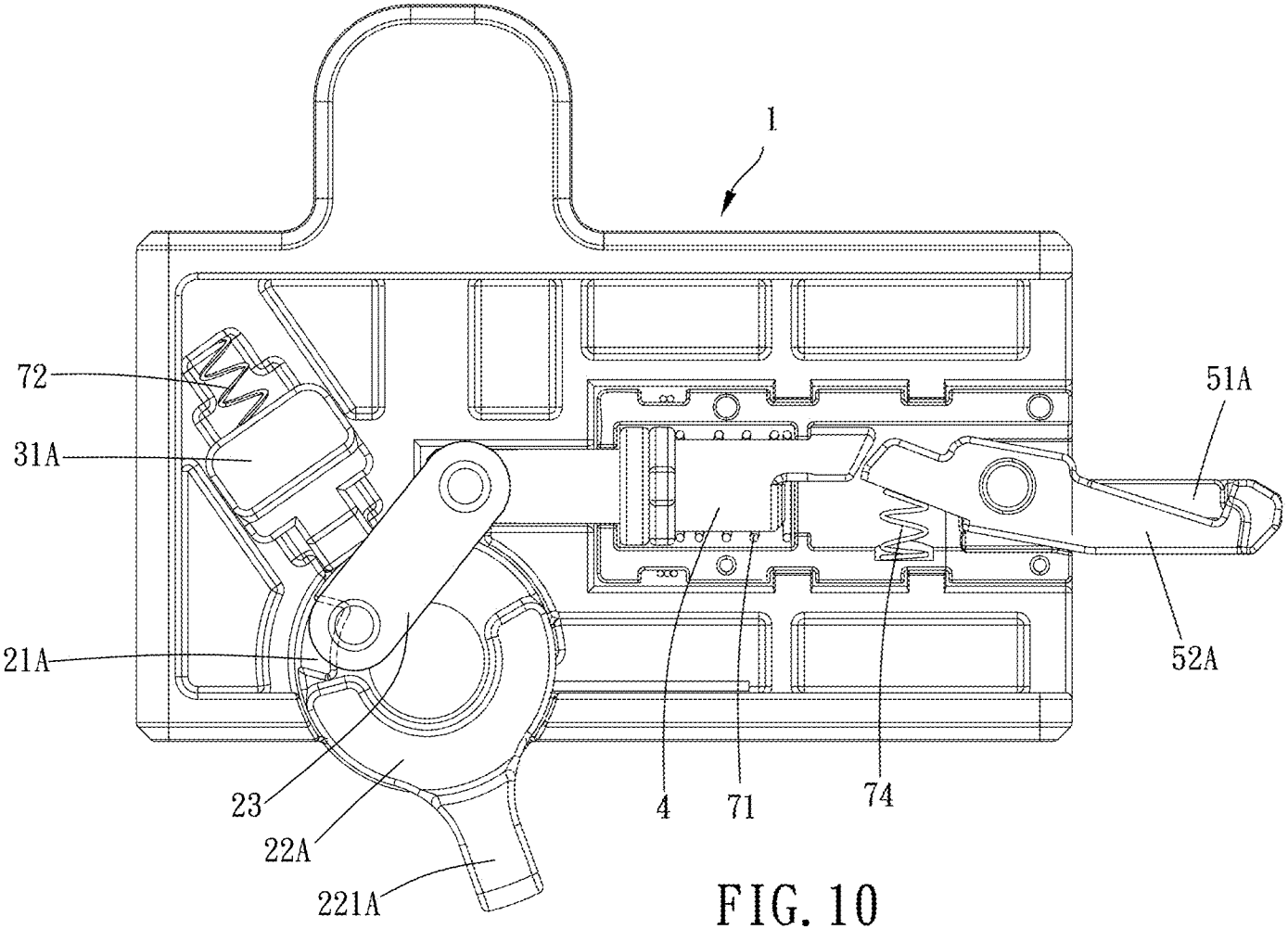
FIGS. 10 and 11 are top views of the second preferred embodiment of the present invention in operation.
Figure 11:
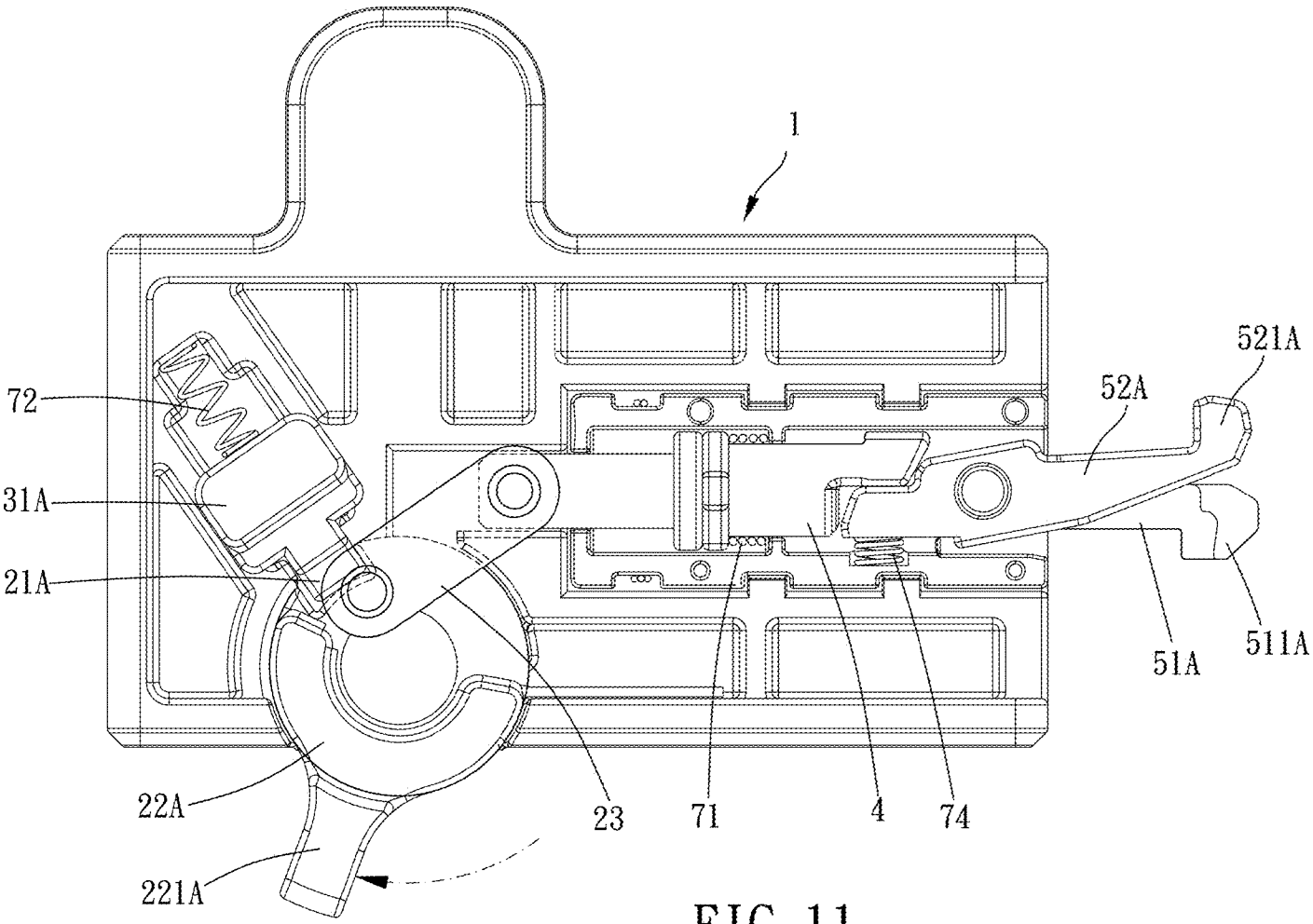
Figure 12:
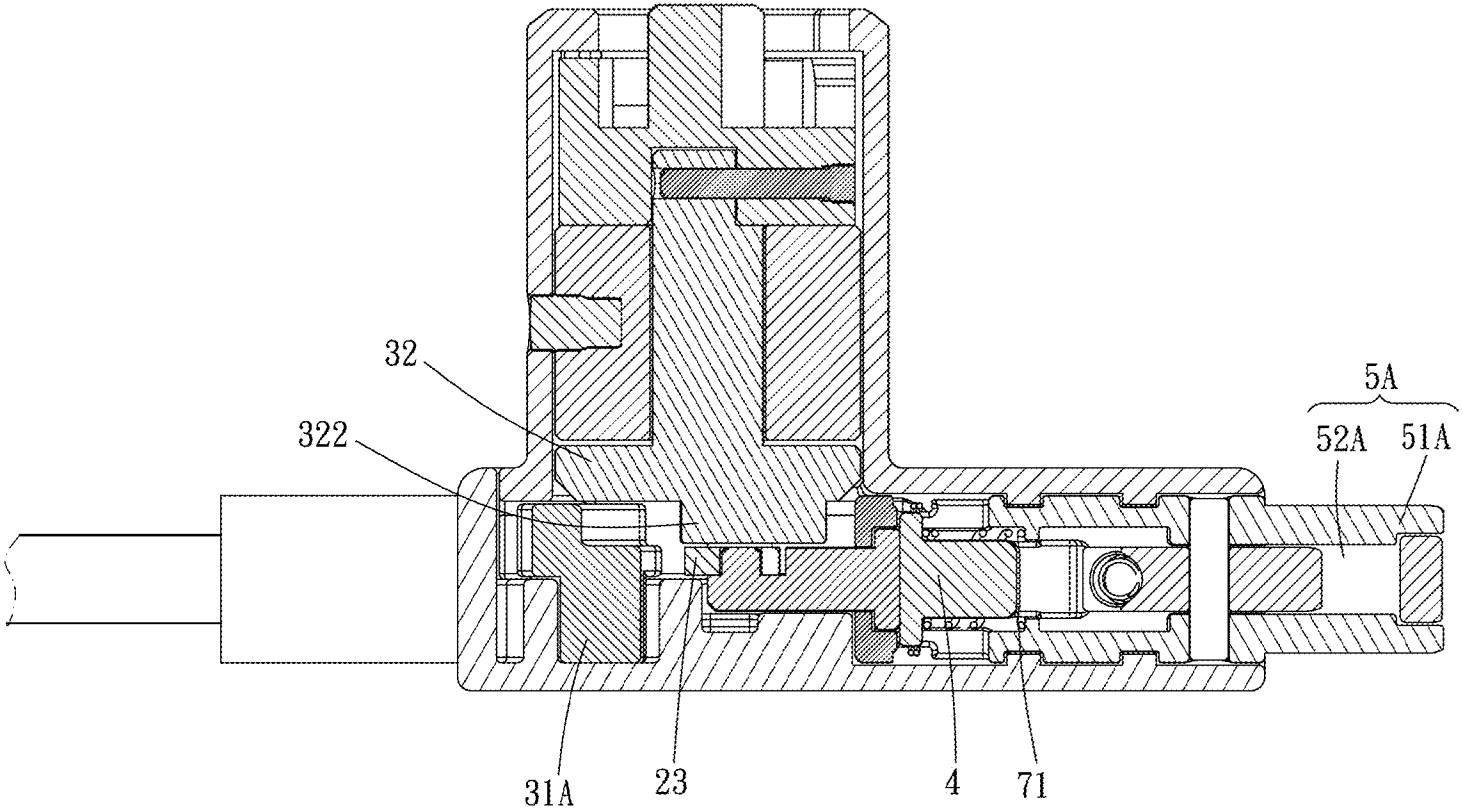
FIG. 12 is a cross-sectional side view of the second preferred embodiment of the present invention.

Compared with the first embodiment mentioned above, in a second embodiment as shown in FIGS. 8 to 12, the control member 22A of the driving assembly 2A is rotatably connected to the shell body 1A, the third elastic member 73A is a torsion spring which is arranged between the control member 22A and the shell body 1A, the control end 221A is radially disposed on the control member 22A, the control member 22A is rotatable between the first position and the second position, the linkage 23 can actuate the actuating member 4 to move by rotating the control member 22A, and when the rotating member 32 rotates to the second position, the lock member 31A can be actuated by the second elastic member 72 to abut against the engaging portion 21A.

In addition, in this embodiment, the first engaging member 51A is fixedly disposed to the shell body 1A, the second engaging member 52A is rotatably connected to the shell body 1, when the actuating member 4 moves toward the engaging assembly 5A, the actuating member 4 abuts against an end of the second engaging member 52A opposite to the second clip 521 to make the second engaging member 52A swing, the first clip and the second clip 511, 521 move away from each other, and the engaging assembly 5A is in the engaged position; when the actuating member 4 moves away from the engaging assembly 5A, the actuating member 4 is free of abutment against the second engaging member 52A, and the first clip and the second clip 511, 521 move toward each other.

Preferably, the engaging assembly 5A further includes a fourth elastic member 74, the fourth elastic member 74 is disposed between the shell body 1 and the second engaging member 52A so that the first and second clips 511, 521 have tendencies to move toward each other, and when the actuating member 4 is free of abutment against the second engaging member 52A, the first clip 511 and the second clip 521 move toward each other, and the engaging assembly 5A is in the released position. Other structures are the same as the first embodiment.

Figure 13:
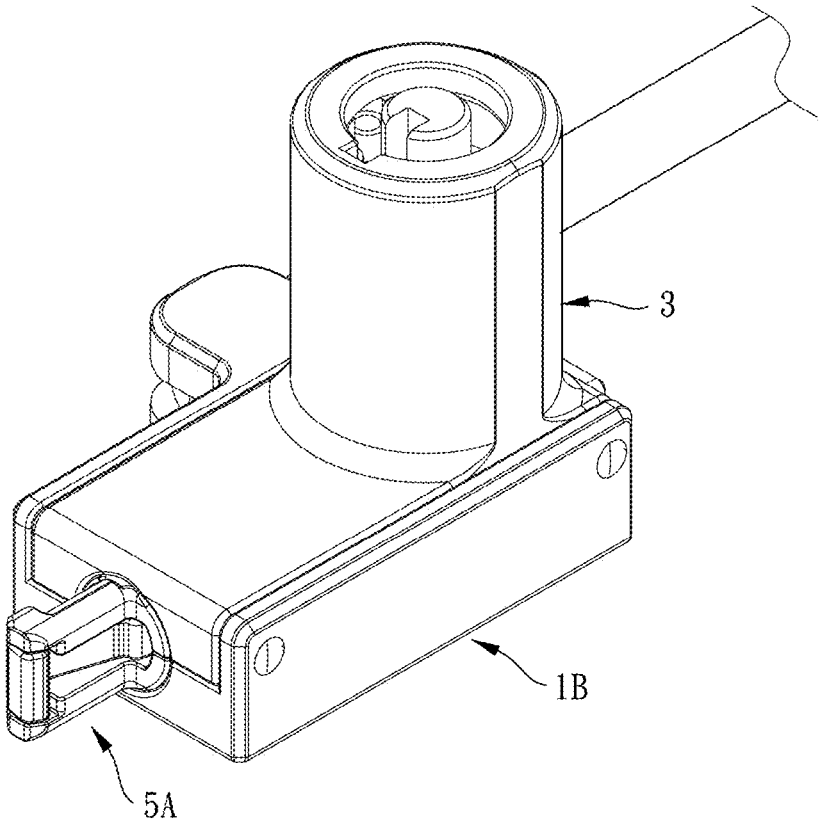
FIG. 13 is a stereogram of a third preferred embodiment of the present invention.
Figure 14:
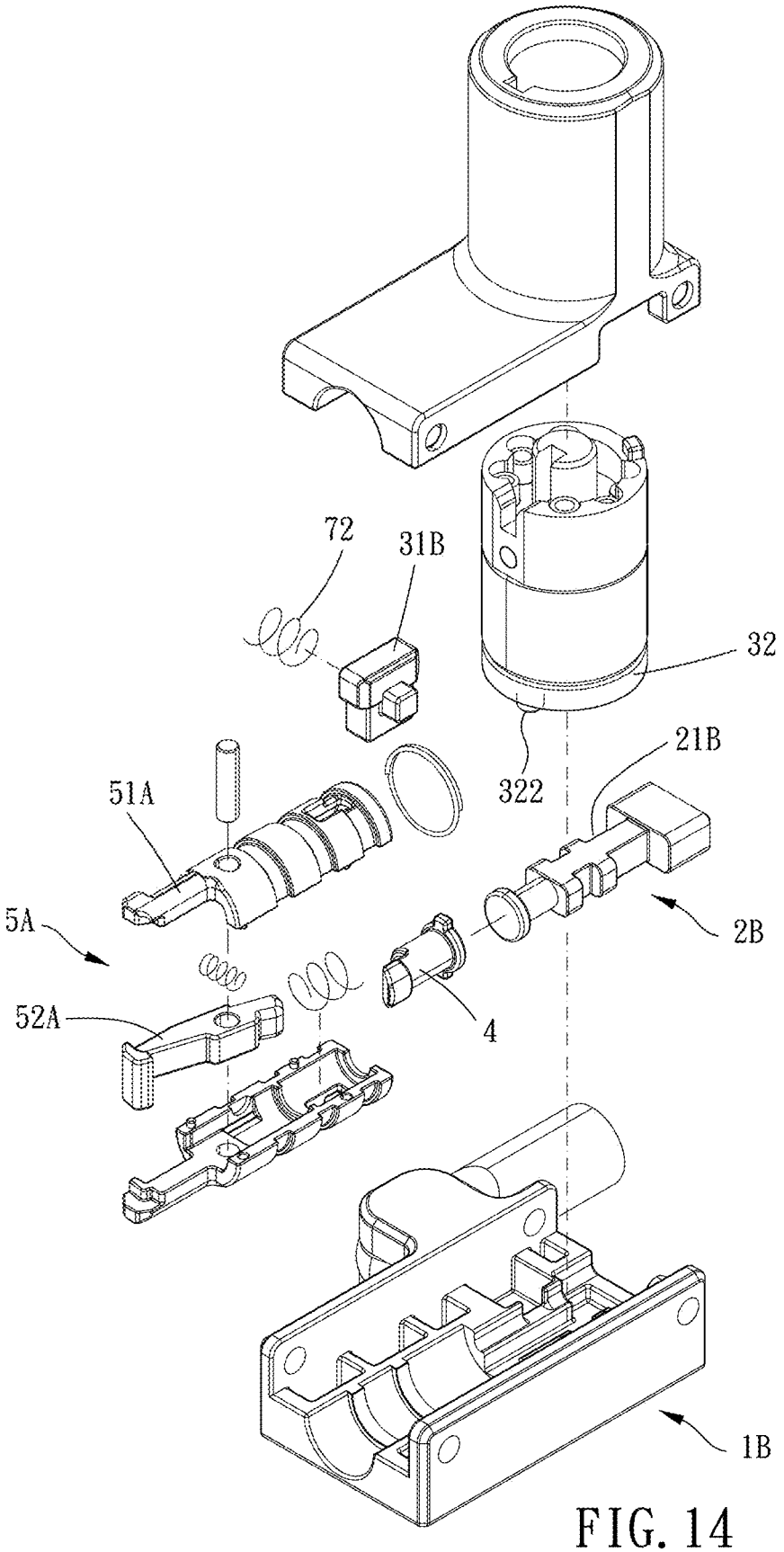
FIG. 14 is a breakdown view of the third preferred embodiment of the present invention.
Figure 15:
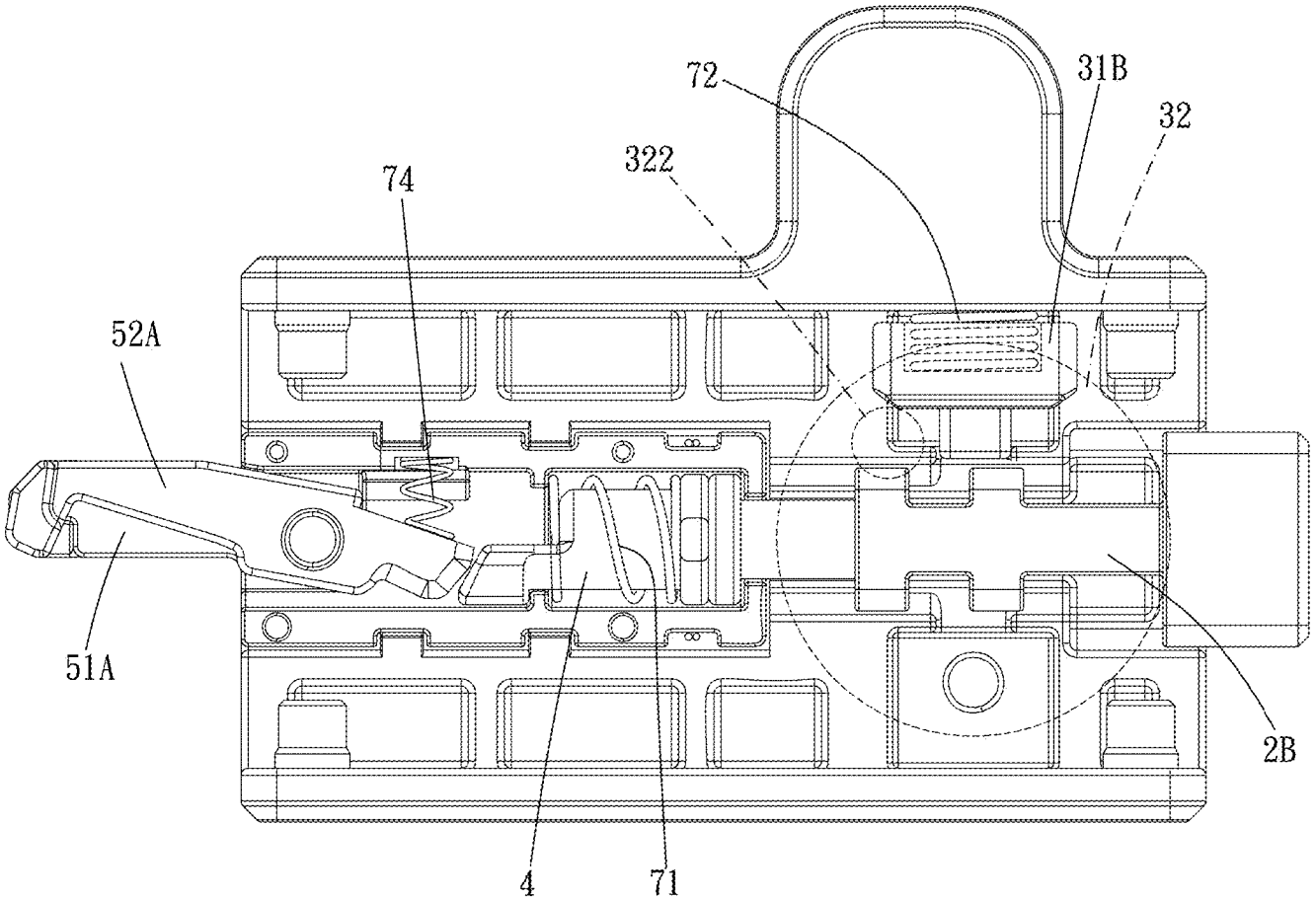
FIGS. 15 and 16 are top views of the third preferred embodiment of the present invention in operation.
Figure 16:
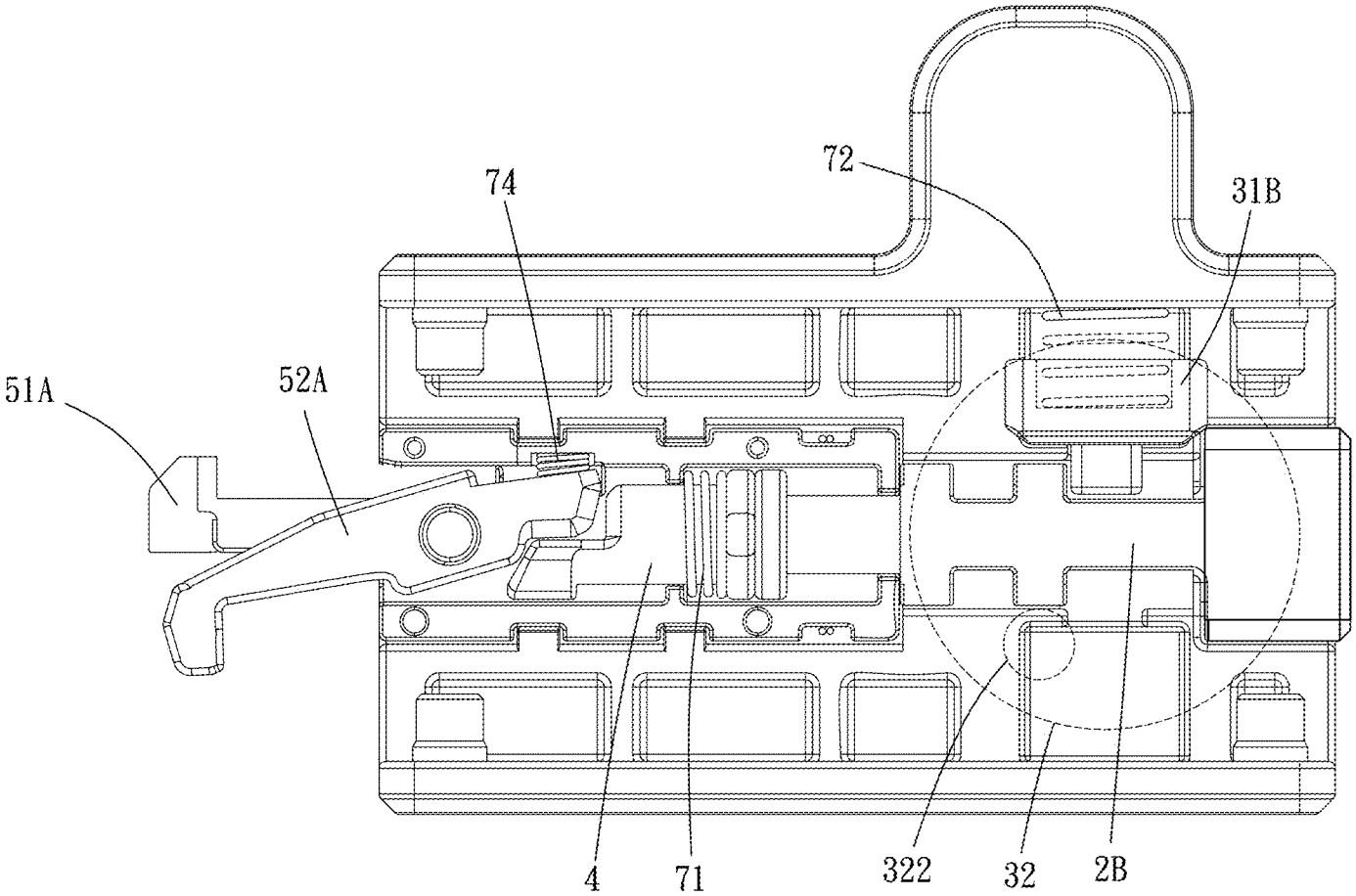

Compared with the second embodiment mentioned above, in a third embodiment as shown in FIGS. 13 to 16, the driving assembly 2B is slidable arranged in the shell body 1B, a sliding direction of the driving assembly 2B is the same as a sliding direction of the actuating member 4, the driving assembly 2B slides toward the actuating member 4 to the second position, the driving assembly 2B slides away from the actuating member 4 to the first position, and when the driving assembly 2B slides to the second position, the lock member 31B can be actuated by the second elastic member 72 to be engaged with the engaging portion 21B. Other structures are the same as the first embodiment.

Given the above, when the driving assembly is in the first position, the engaging assembly is in the released position and non-engageable against an edge of the anti-theft hole, the engaging assembly can be optionally disassembled from the anti-theft hole; when the driving assembly is moved to the second position by a force, the lock member moves to the locked position and is engaged with the restricting portion, the engaging assembly is actuated by the actuating member to move to the engaged position, and the engaging assembly is engaged with the edge of the anti-theft hole so that the engaging assembly cannot be detached from the anti-theft hole, and the object can be prevented from being stolen. The connection lock has a simple structure and is easy to operate, so it saves a great amount of time of assembling or disassembling the connection lock, and consumers would be more willing to purchase the connection lock.

While we have shown and described various embodiments in accordance with the present invention, it should be clear to those skilled in the art that further embodiments may be made without departing from the scope of the present invention.

What is claimed is:

1. A connection lock, including:

a shell body;

a driving assembly, disposed to the shell body and being movable to be in a first position or a second position, the driving assembly further having a restricting portion;

a lock device, disposed to the shell body, the lock device including a lock member, the lock member being movable relative to the shell body to be in an unlocked position or a locked position, the lock member having a tendency to move toward the locked position;

an actuating member, slidably disposed in the shell body;

a first elastic member, disposed in the shell body and abutting against one of the actuating member and the driving assembly to bias the driving assembly in a direction toward the first position;

an engaging assembly, disposed in the shell body and being movable to be in a released position or an engaged position, the engaging assembly configured to be inserted into an anti-theft hole of an object;

wherein when the driving assembly is in the first position, the engaging assembly is in the released position and non-engageable against an edge of the anti-theft hole, the lock member is in the unlocked position and non-engageable against the restricting portion, and the driving assembly is freely movable toward the second position; when the driving assembly moves to the second position, the lock member moves to the locked position and is engaged with the restricting portion, the actuating member is driven by the driving assembly, the engaging assembly is actuated by the actuating member to move to the engaged position, and the engaging assembly is engaged with the edge of the anti-theft hole;

wherein the driving assembly includes a control member and a linkage, the control member has a control end, the control end is outside the shell body, the control end is movably arranged on the shell body, and two ends of the linkage are respectively pivoted to the actuating member and the control member.

2. The connection lock of claim 1, further including a second elastic member, the second elastic member arranged between the lock member and the shell body to normally bias the lock member toward the locked position.

3. The connection lock of claim 2, wherein the restricting portion is disposed in a recess of the driving assembly, and when the lock member is in the locked position, the lock member is inserted into and engaged with the recess.

4. The connection lock of claim 1, wherein the first elastic member is arranged between the shell body and the actuating member, and the actuating member has a tendency to move away from the engaging assembly to actuate the driving assembly to move toward the first position.

5. The connection lock of claim 1, wherein the control member is slidably arranged in the shell body, a sliding direction of the control member is lateral to a sliding direction of the actuating member, and the control member is slidable between the first position and the second position.

6. The connection lock of claim 5, further including a third elastic member, the third elastic member being arranged between the shell body and an end of the control member remote from the control end.

7. The connection lock of claim 1, wherein the control member is rotatably connected to the shell body, the control end is radially disposed on the control member, and the control member is rotatable between the first position and the second position.

8. The connection lock of claim 1, wherein the driving assembly is slidable arranged in the shell body, a sliding direction of the driving assembly is the same as a sliding direction of the actuating member, the driving assembly slides toward the actuating member to the second position, and the driving assembly slides away from the actuating member to the first position.

9. The connection lock of claim 1, wherein the engaging assembly includes a first engaging member and a second engaging member which are movable relative to each other, an end of the first engaging member and an end of the second engaging member remote from the actuating member respectively have a first clip and a second clip, when the engaging assembly is in the engaged position, the first and the second clips move relative to each other to be engaged with the edge of the anti-theft hole; and when the engaging assembly is in the released position, the first and the second clips move relative to each other to be non-engaged with the edge of the anti-theft hole.

10. The connection lock of claim 9, wherein the first engaging member is fixedly disposed to the shell body, the second engaging member is rotatably connected to the shell body, when the actuating member moves toward the engaging assembly, the actuating member abuts against an end of the second engaging member opposite to the second clip to make the second engaging member swing, the first clip and the second clip move away from each other, and the engaging assembly is in the engaged position; when the actuating member moves away from the engaging assembly, the actuating member is free of abutment against the second engaging member, and the first clip and the second clip move toward each other.

11. The connection lock of claim 10, wherein the engaging assembly further includes a fourth elastic member, and the fourth elastic member disposed between the shell body and the second engaging member so that the first and second clips have tendencies to move toward each other.

12. The connection lock of claim 9, wherein the first engaging member is fixedly disposed to the shell body, the second engaging member is slidably arranged in the shell body and rotatably connected to the actuating member, when the actuating member moves away from the driving assembly, the actuating member actuates the second engaging member to move toward an outside of the shell body so that the first and second clips are aligned with each other, and the engaging assembly is in the engaged position; when the actuating member moves away from the engaging assembly, the actuating member actuates the second engaging member to move toward an inside of the shell body so that the first and second clips are non-aligned with each other, and the engaging assembly is in the released position.

13. A connection lock of claim 1, including:

a shell body;

a driving assembly, disposed to the shell body and being movable to be in a first position or a second position, the driving assembly further having a restricting portion; a lock device, disposed to the shell body, the lock device including a lock member, the lock member being movable relative to the shell body to be in an unlocked position or a locked position, the lock member having a tendency to move toward the locked position; an actuating member, slidably disposed in the shell body;

a first elastic member, disposed in the shell body and abutting against one of the actuating member and the driving assembly to bias the driving assembly in a direction toward the first position;

an engaging assembly, disposed in the shell body and being movable to be in a released position or an engaged position, the engaging assembly configured to be inserted into an anti-theft hole of an object;

wherein when the driving assembly is in the first position, the engaging assembly is in the released position and non-engageable against an edge of the anti-theft hole, the lock member is in the unlocked position and non-engageable against the restricting portion, and the driving assembly is freely movable toward the second position; when the driving assembly moves to the second position, the lock member moves to the locked position and is engaged with the restricting portion, the actuating member is driven by the driving assembly, the engaging assembly is actuated by the actuating member to move to the engaged position, and the engaging assembly is engaged with the edge of the anti-theft hole;

wherein the lock device has a rotating member, the rotating member has a key hole, an end of the rotating member remote from the key hole has a protrusion, and when the rotating member rotates, the protrusion abuts against the lock member and the the lock member moves to the unlocked position.

14. The connection lock of claim 13, wherein the lock member has an inclined face, the inclined face tilts toward a moving direction of the lock device, and the protrusion abuts against the inclined face.

* * * * *